United States Patent [19]

Vikroff

[11] Patent Number: 4,552,482

[45] Date of Patent: Nov. 12, 1985

[54] JUNCTION FOR CONNECTION AND ASSEMBLY OF TRUNCATED CONICAL-PYRAMIDAL GEOMETRIC SHAPE FOR MULTI-DIRECTIONAL ELEMENTS OF THREE-DIMENSIONAL STRUCTURES

[76] Inventor: Alexis Vikroff, 10 rue du Congres, 06000 Nice, France

[21] Appl. No.: 463,245

[22] Filed: Feb. 2, 1983

[30] Foreign Application Priority Data

Feb. 5, 1982 [FR] France ..... 82 02130

[51] Int. Cl.[4] ..... F16B 7/00

[52] U.S. Cl. ..... 403/172; 403/217; 52/81

[58] Field of Search ..... 403/172, 171, 170, 202, 403/217, 219, 176; 52/648, 654, 655, 81

[56] References Cited

U.S. PATENT DOCUMENTS

| | | | |
|---|---|---|---|
| 1,965,634 | 7/1934 | Fishel | 403/171 |
| 3,563,580 | 2/1971 | Black | 403/172 |
| 3,844,074 | 10/1974 | Ahern | 52/81 |
| 3,844,664 | 10/1974 | Hogan | 403/171 |
| 3,861,107 | 1/1975 | Papayoti | 403/172 X |
| 4,070,847 | 1/1978 | Madl, Jr. | 403/171 X |
| 4,145,149 | 3/1979 | Ruga | 403/176 X |
| 4,332,501 | 6/1982 | Slysh | 403/171 X |

FOREIGN PATENT DOCUMENTS

| | | |
|---|---|---|
| 2081161 | 12/1971 | France . |
| 2230931 | 12/1974 | France . |
| 2350542 | 12/1976 | France . |
| 2386714 | 11/1978 | France . |
| 1306925 | 2/1973 | United Kingdom . |

*Primary Examiner*—Andrew V. Kundrat
*Attorney, Agent, or Firm*—Young & Thompson

[57] ABSTRACT

Junction for connection and assembly of truncated conical-pyramidal geometric shapes for multi-directional elements of three-dimensional structures, comprises a rigid envelope of truncated conical-pyramidal shape whose small base is continuous and whose large base is disposed on the perimeter of a polygon on the flat sides of the pyramid and on the internal or external surfaces of the envelope or on both, structural elements can be secured in known ways. The small base surrounds a hole for the passage of securement or assembly devices. A plurality of such joints can be assembled, with their small bases adjacent each other, to form a composite joint. The structure is useful for the construction of metallic three-dimensional structures.

9 Claims, 32 Drawing Figures

4

2
N1
N1
4
3
3
12
3
12

N2
N2

JUNCTION FOR CONNECTION AND ASSEMBLY OF TRUNCATED CONICAL-PYRAMIDAL GEOMETRIC SHAPE FOR MULTI-DIRECTIONAL ELEMENTS OF THREE-DIMENSIONAL STRUCTURES

In the field of construction, particularly metallic construction, the role played by three-dimensional structures is known and their usefulness is established.

There are a number of structures of this type to choose from. Triangular beams are known, planar structures, spacial structures, large interval structures . . . they permit in general the construction of large buildings and roofs of great width, of various shapes: flat, or of simple or compound curvature.

It is known that these structures provide both great lightness and great rigidity and that they are characteristically comprised by straight rods, subjectd to perpendicular loading, or tension or compression, without localized bending, assembled at their ends by joints to which are applied the working loads.

It is also known that the most complicated element of these assemblies is the assembly joint because it is the point of juncture of the rods of various cross sections coming from various directions, which can transmit unequal forces.

Clearly, for a given structure, one seeks to increase, from the manufacturing standpoint, the number of each production run of joints to decrease their cost of manufacture. But from one structure to another and from one type of structure to another, the need for a joint of modular type is apparent.

The invention has for its object a joint adapted to be, for a given design, depending on its function, useful in various types of assembly by a simple operation of combination.

The invention thereby avoids the above-described drawbacks.

The joint according to the invention is in the form of an envelope of truncated conical-pyramidal geometric form, whose small base 3 is a closed figure, the large base, the perimeter of any type of polygon and whose summit angle $\alpha$ is a function of the shape of the structure to be produced. Said angle $\alpha$ may be between 5° and 175°. The small base is therefore perforate and thus permits the passage of any type of connector or securement. Preferably, the shape of the large polygonal base 1, seen in elevation from above, has for its perimeter the periphery of a square 1.

If needed in the structure to be produced, a portion of the truncated conical-pyramidal envelope surface 4 may be eliminated to leave one of several assembly tongues or legs 5, 6, 7 and 8. These tongues or legs have a flat surface. These assembly tongues or legs may be turned down about an angle of 90°, either downwardly or upwardly.

BRIEF DESCRIPTION OF DRAWINGS

The shape chosen for the description and its ease of graphic representation, as shown in FIG. 1*a* seen in elevation and in FIG. 1*b* seen from above, and has for its large base the perimeter of a square. The theoretical outline of the member is shown in broken lines and its contour in continuous lines.

So as to provide a member as light as possible, it is possible to eliminate therefrom certain portions, for example, the part shown in broken line at 2, FIG. 1*b*, to obtain, as can be seen in the elevation of FIG. 2*a* and from above in FIG. 2*b*, a reduced member or a severely reduced member as shown in FIGS. 7*a* and 7*b*. There thus remains, in these cases, only the usable side portions with their assembly function and the central portion which serves, with its opening and preferably, to interconnect the joints as shown in FIGS. 3, 4, 5 and 6 in a firm manner and to comprise a unitary assembly.

Figure 3:
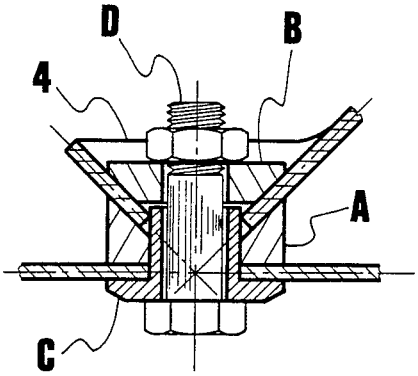

The cohesiveness and solidity of this unit may be achieved in other ways, with the help of auxiliary members, for example:

FIG. 3: with a spacer A, two rings B and C and a bolt D, prestressed or not.

Figure 4:
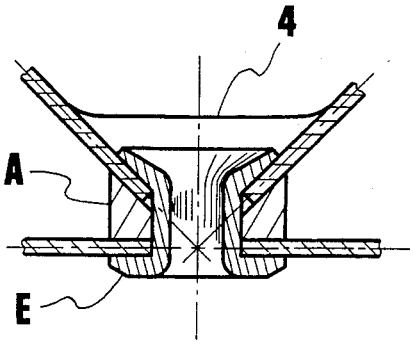

FIG. 4: the same case but with another securement element, a tubular or solid rivet E.

Figure 5:
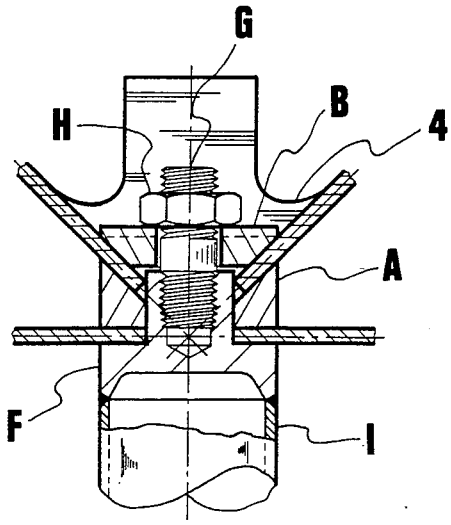

FIG. 5: this assembly unit combines the joints of the preceding figures and the accessories A and B with the tip of the tube F to be welded or screwed on, a stud G and a nut H. The tube I may be either a post or any other structural element.

Figure 6:
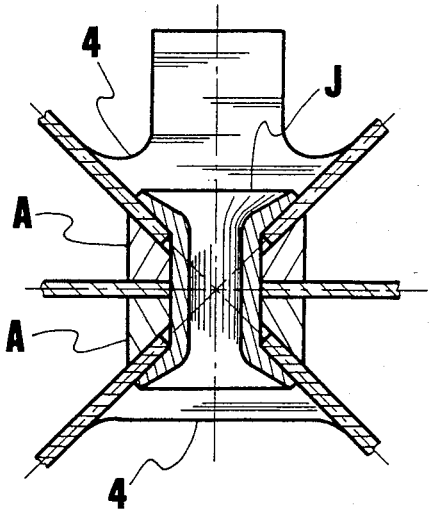

FIG. 6: the combination of three joints of which one is relatively flat and two stays A and a tubular or solid rivet J.

It will be noted that in the cross-sectional views of FIGS. 3, 4, 5 and 6, each joint may have, before complete assembly, a different orientation with respect to the others, which adds the characteristic that, the tubular rivet having an opening at its center, free for any use, without impairing the rigidity of the assembled unit, the joints may have different summit angles and different lateral portions, the accessories being accordingly adapted.

These are the lateral portions or assembly tongues which serve for connection of the joints with the structural rods, their flat shapes facilitating assembly of all commercial profiles by bolting, riveting, welding, cementing or any other process.

Figure 7B:
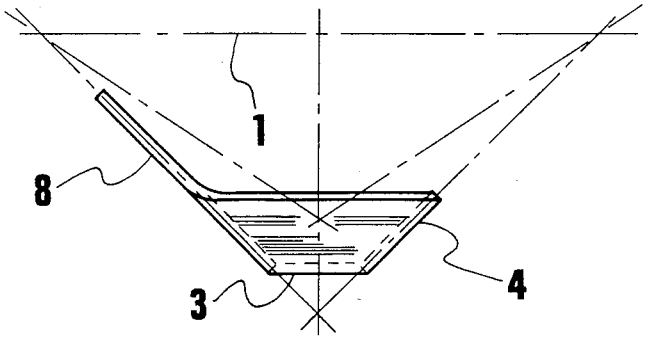
Figure 7A:
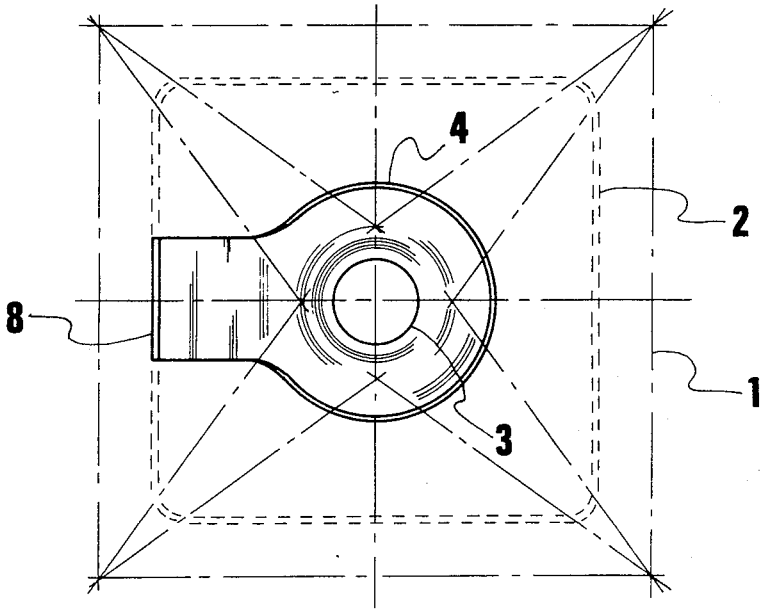
Figure 8A:
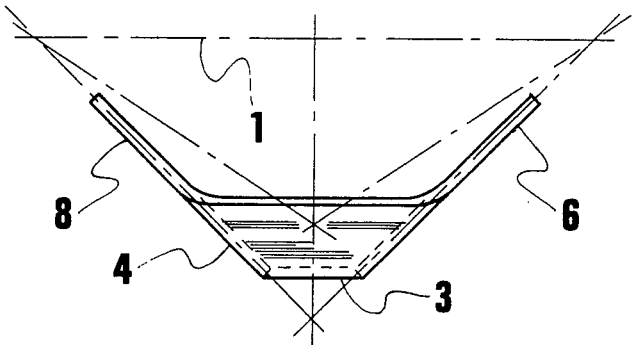
Figure 8B:
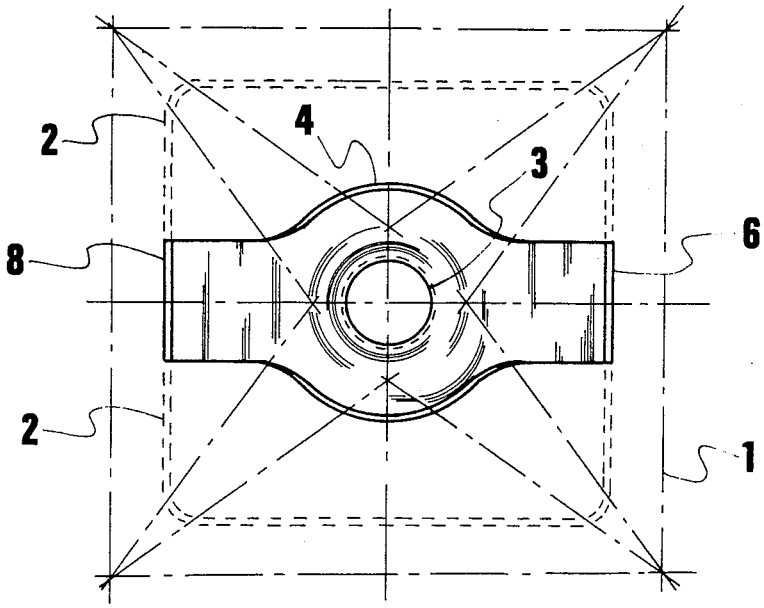

In the type of joint in question, there are other shapes. In FIGS. 7*a* and 7*b* is shown a joint with one connection element, with one leg or tongue. In FIGS. 8*a* and 8*b*, the joint has two legs.

Figure 9:
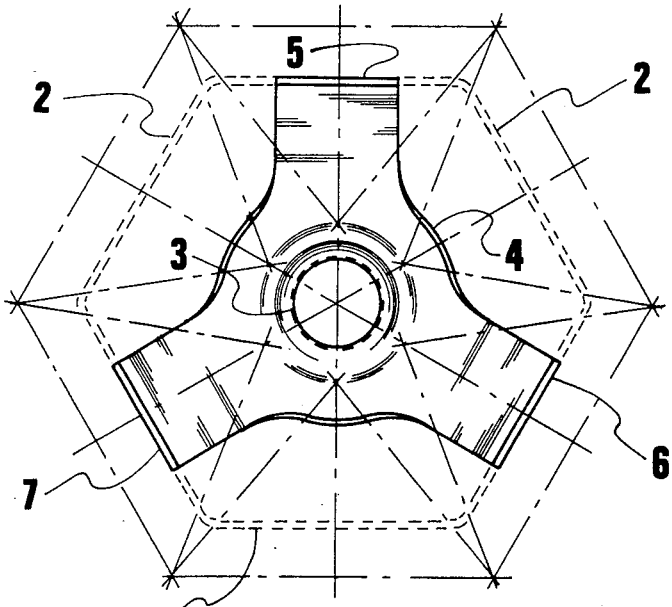
Figure 10:
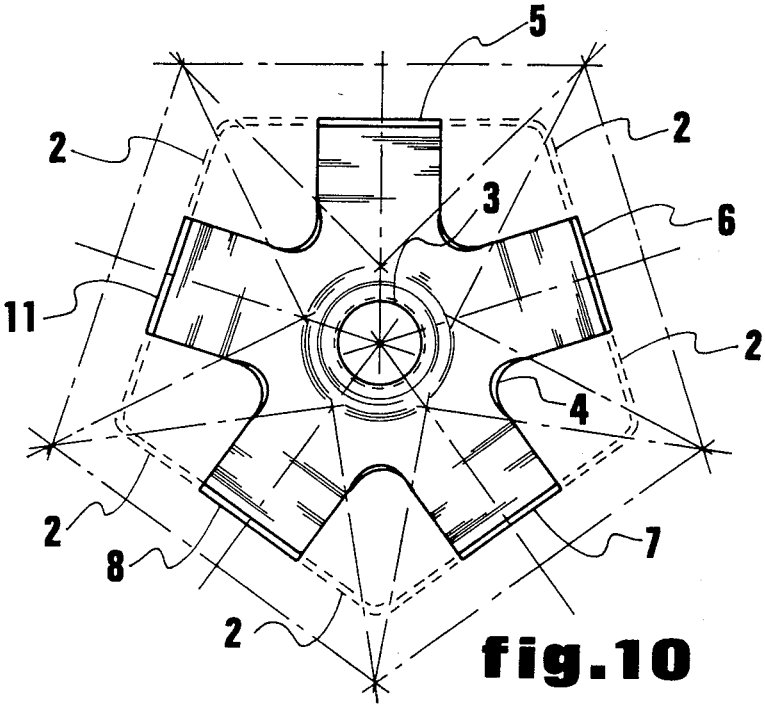

FIGS. 9 and 10 show joints with three and five legs or tongues.

Figures 11A, 11B, 11C:
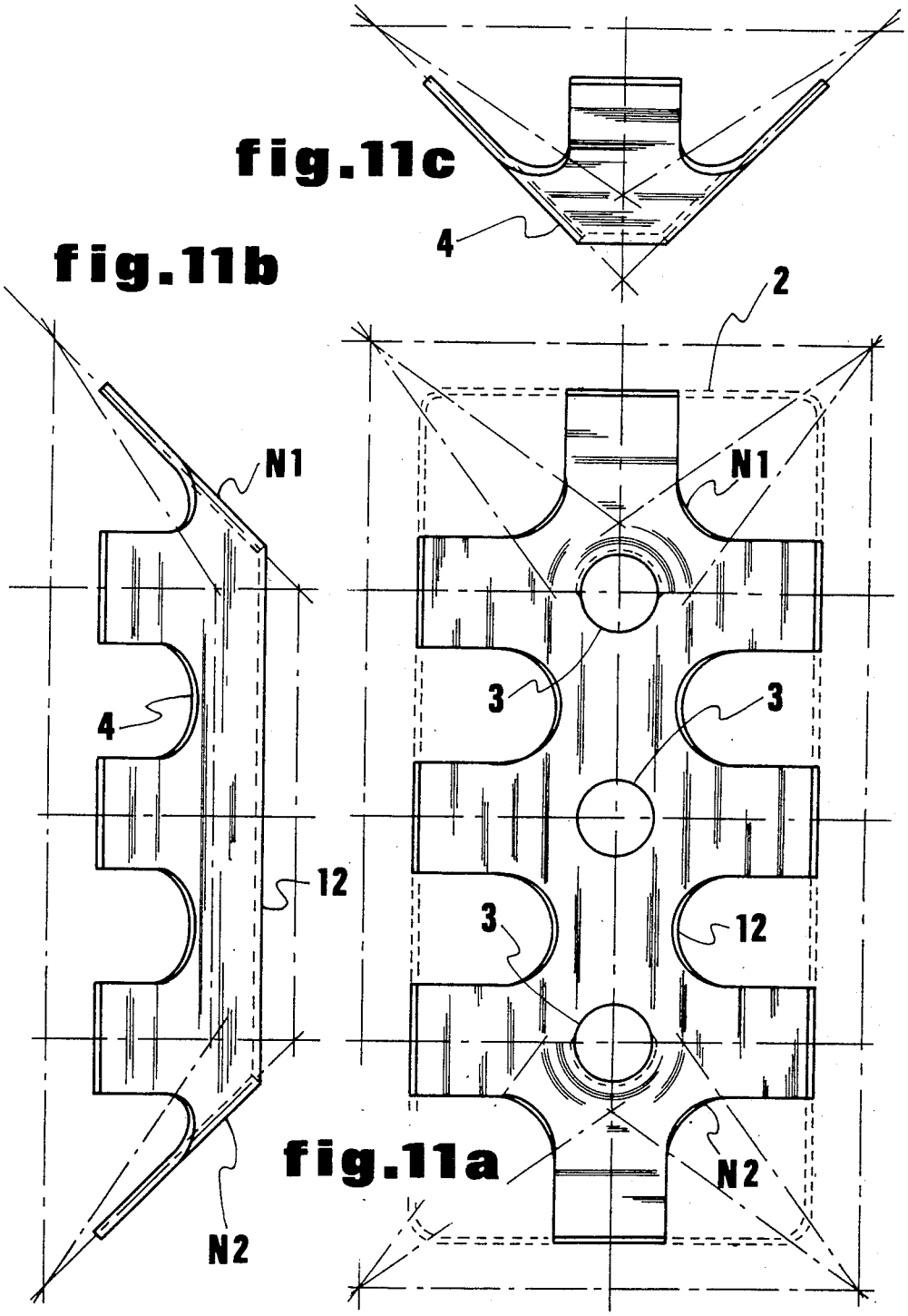

FIGS. 11*a*, 11*b* and 11*c* show an elongated joint, seen from three sides, whose derived shape is the product of the combination of a prism 12 interposed between two semi-legs of the shape of base $N_1$ and $N_2$.

Figure 12:
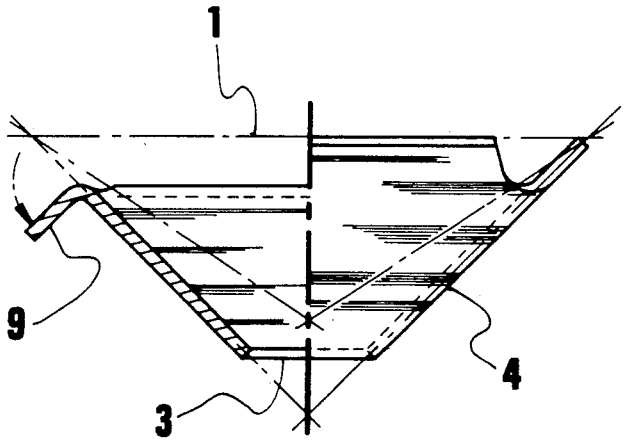
Figure 13:
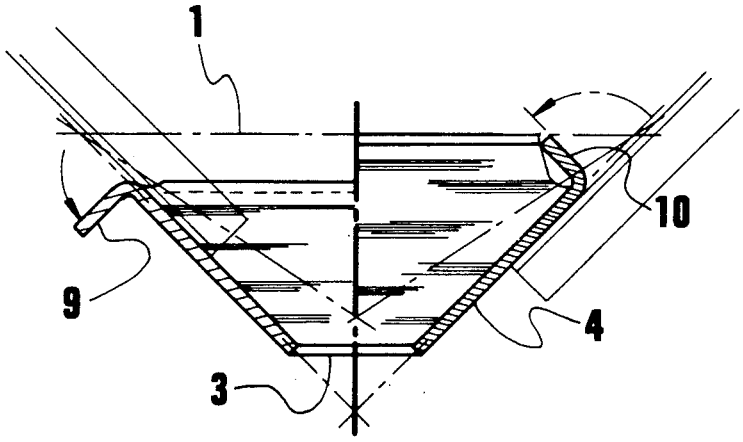

The joints may also have reinforced embodiments such as shown in FIG. 12 from the half shape at the right, it is possible to bend down the sides as indicated in the half section at left, either downwardly, bend 9, or upwardly, bend 10, as shown in the half views of FIG. 13.

Figure 1A:
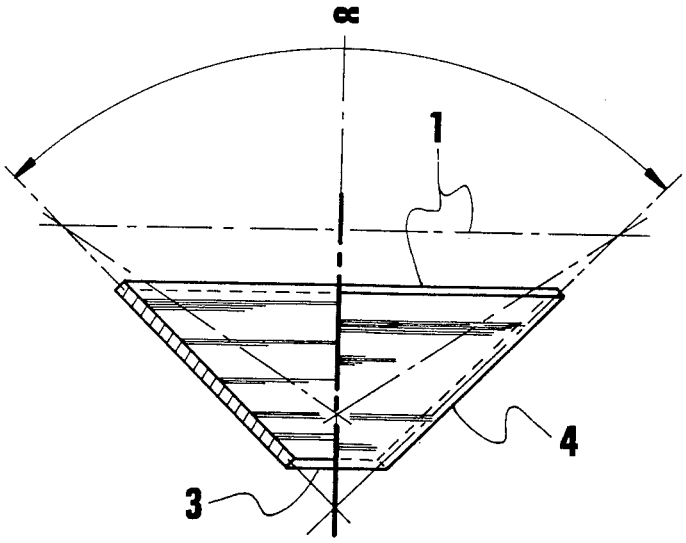
Figure 1B:
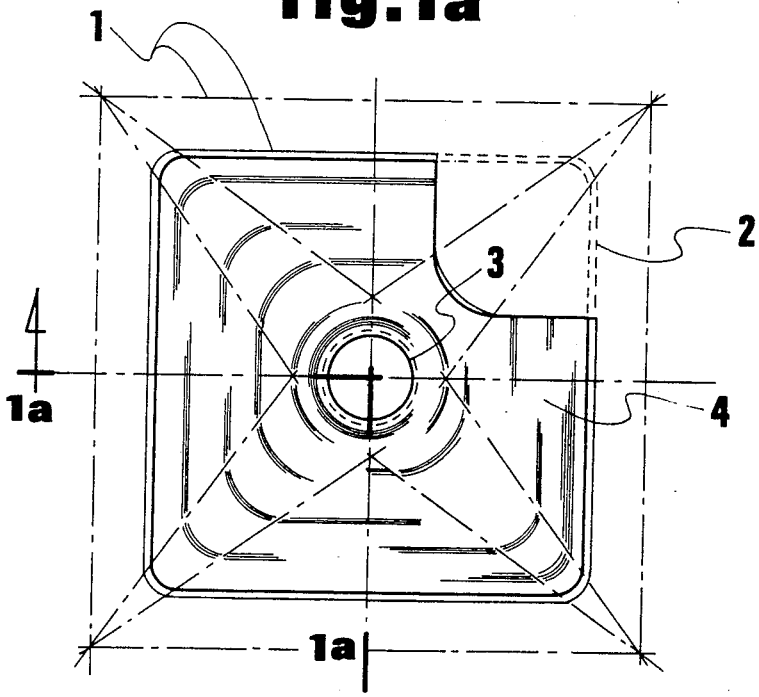
Figure 2A:
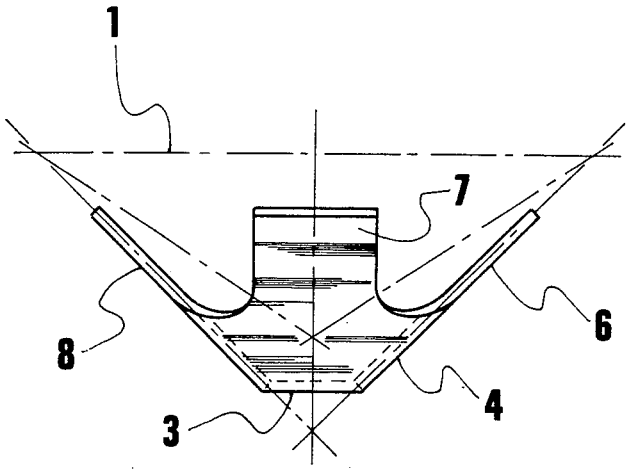
Figure 2B:
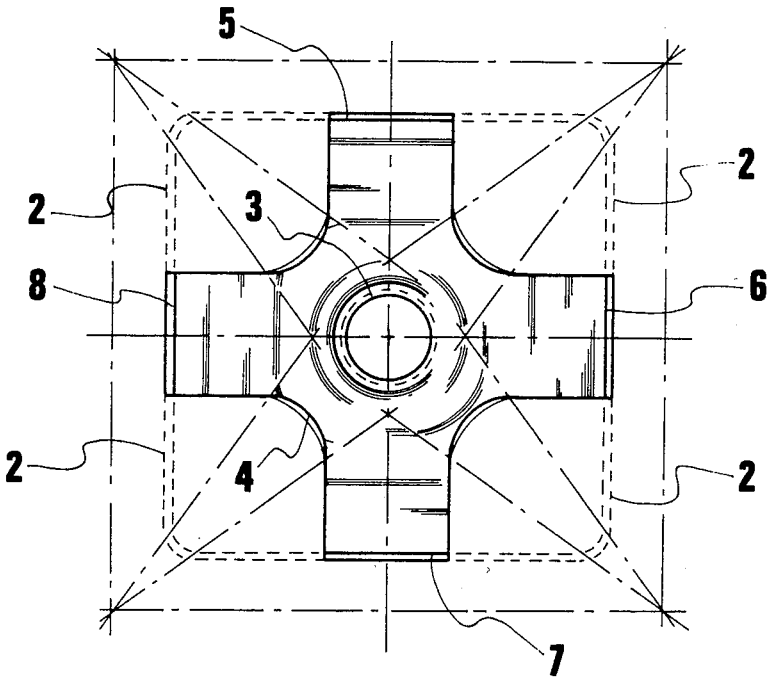

In the following figures are represented schematically and in central cross section, several of the non-limiting combinations of modular joints possible with the basic modular joint shown in FIGS. 2*a*, 2*b* and in which only the summit angle $\alpha$ varies.

It is to be noted that FIGS. 3, 4, 5 and 6 show modular combinations.

Figure 14:
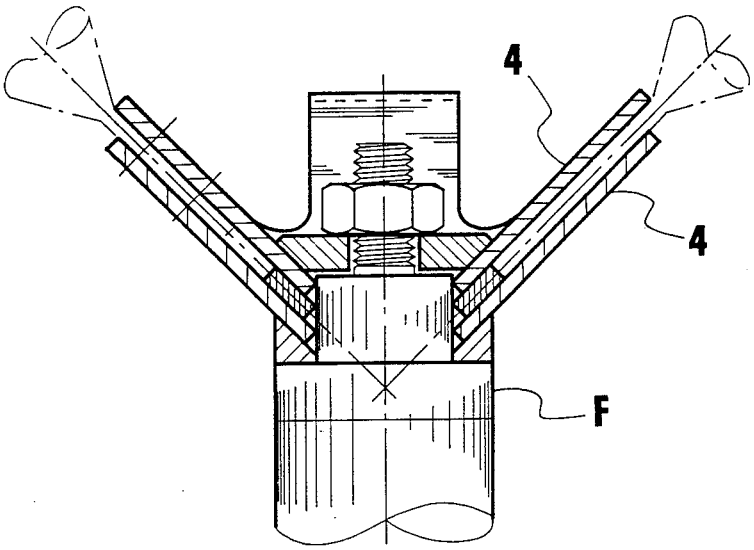

In FIG. 14, is shown a modular combination of joint to create an assembled unit of four simple lateral legs in this embodiment, but other profiles could be used and also a central rod.

The following figures are given by way of non-limitative example. They each show a preferred embodiment according to the invention.

Figure 15:
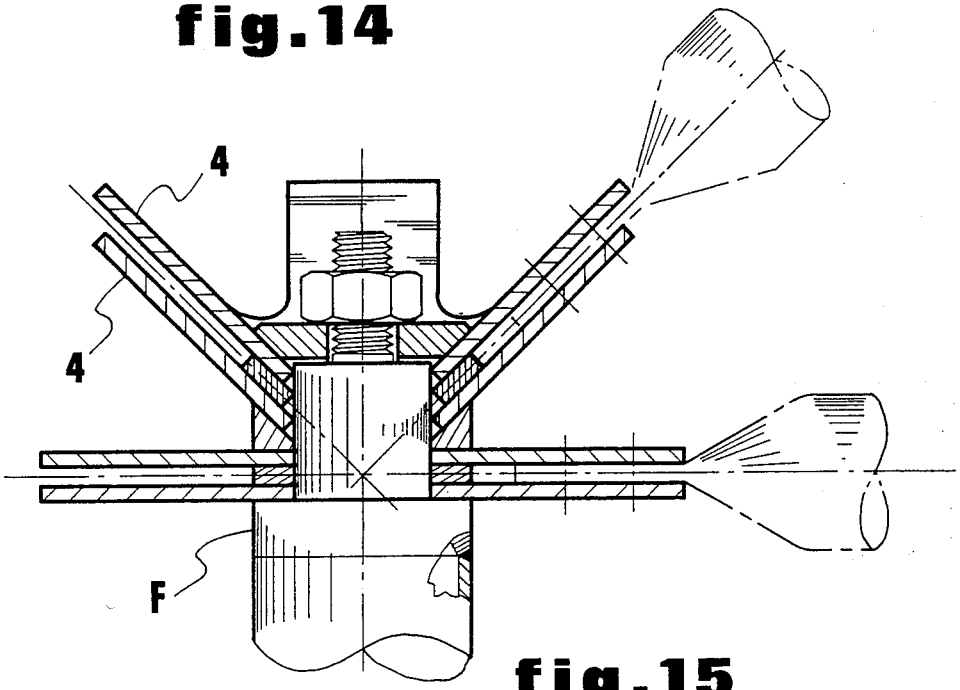

FIG. 15 is a combination of four joints.

Figure 16:
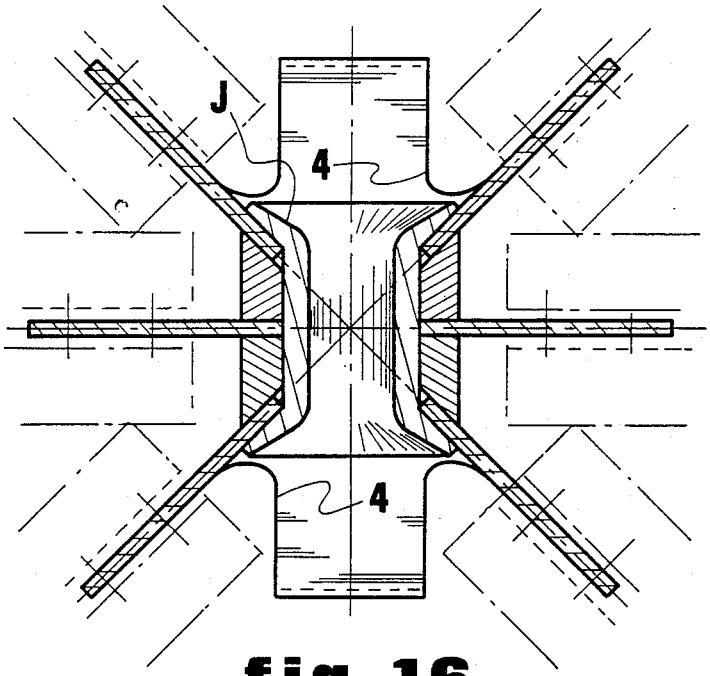

FIG. 16 is a combination of three joints.

Figure 17:
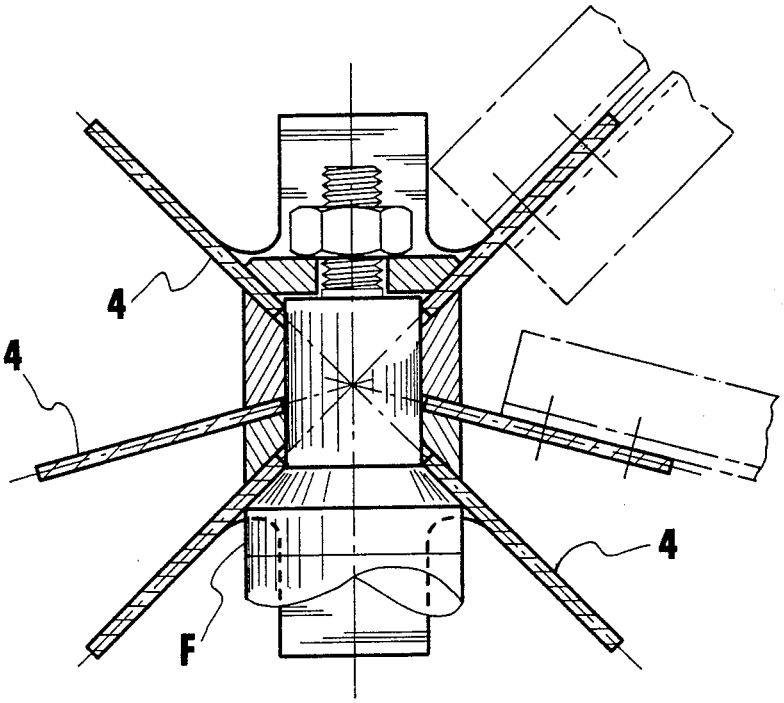

FIG. 17 is a combination of three joints.

Figure 18:
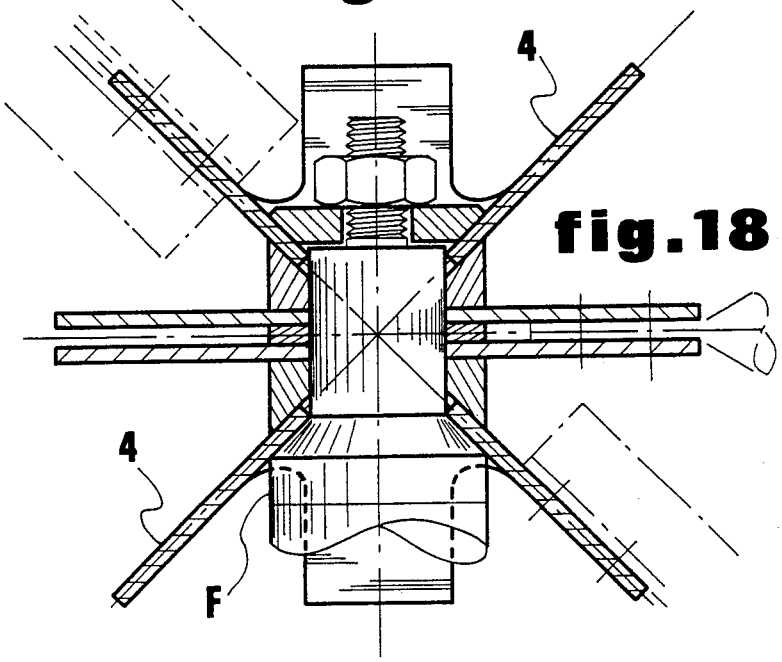

FIG. 18 is a combination of four joints.

Figure 19:
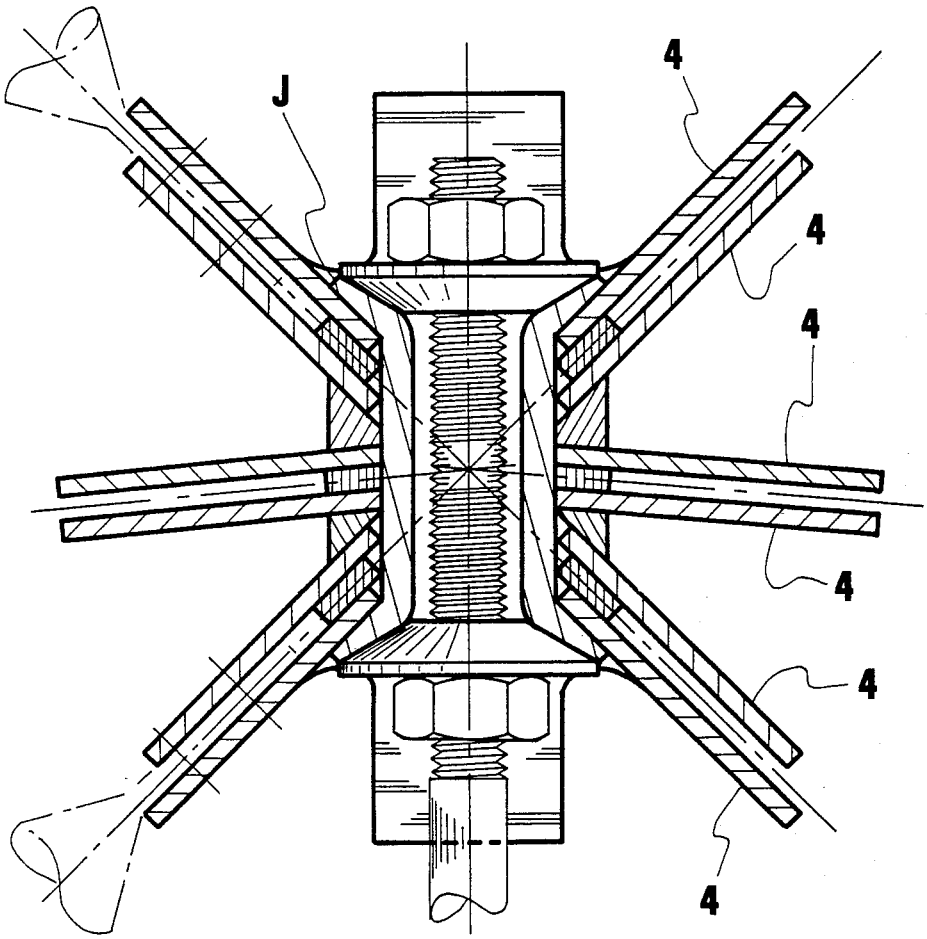

FIG. 19 is a combination of six joints.

Figure 20:
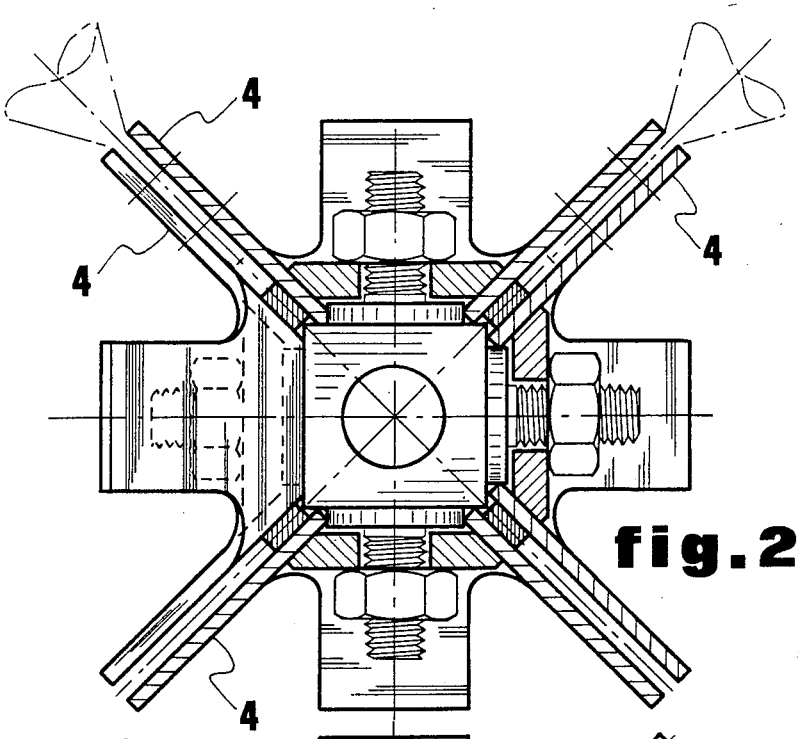

FIG. 20 shows in this embodiment, the combination of six identical joints, assembled by combined bolting and riveting.

Figure 21:
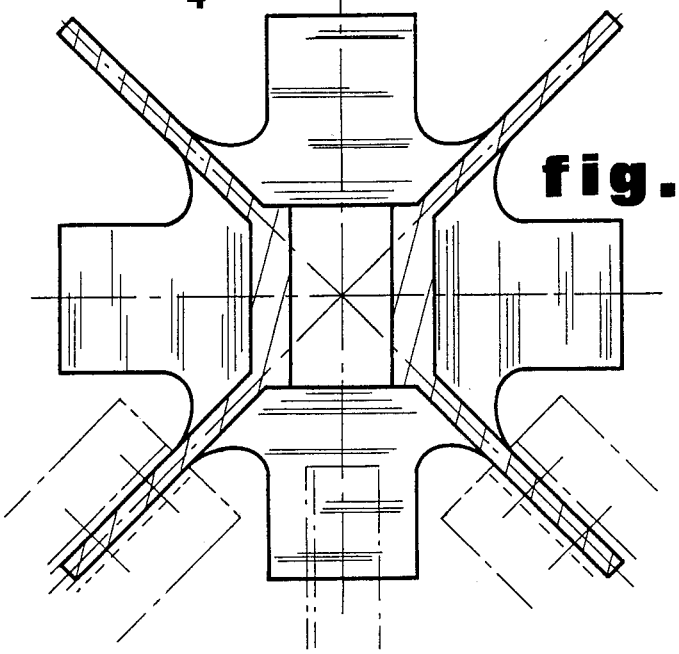

In FIG. 21, the joint is the integral design of the modular combination of FIG. 20.

Figure 22:
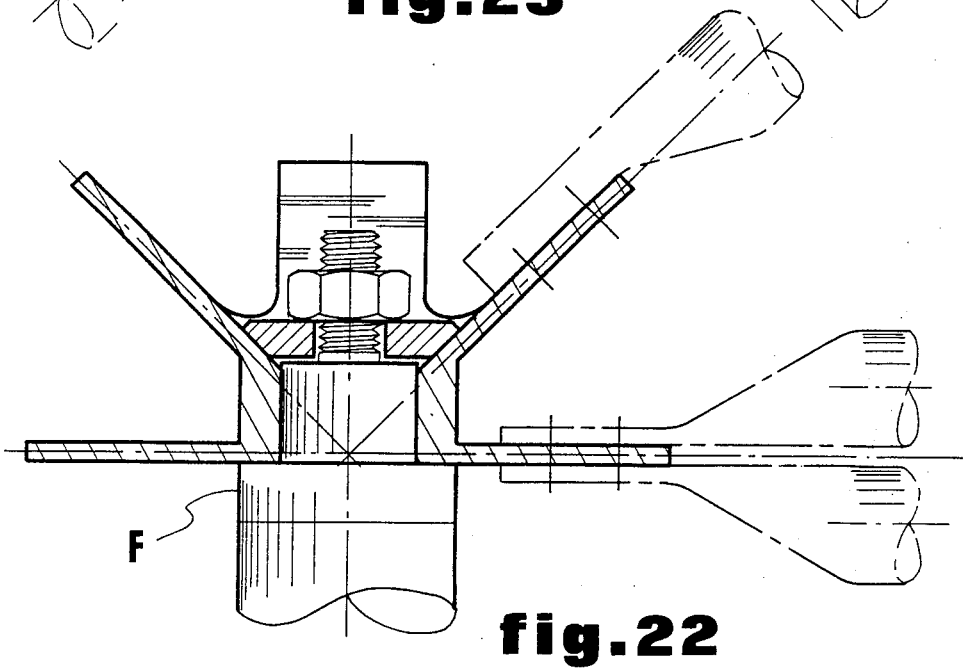

In FIG. 22, the joint is the integral design of the modular combinations represented in FIGS. 3, 4 and 5.

Figure 23:
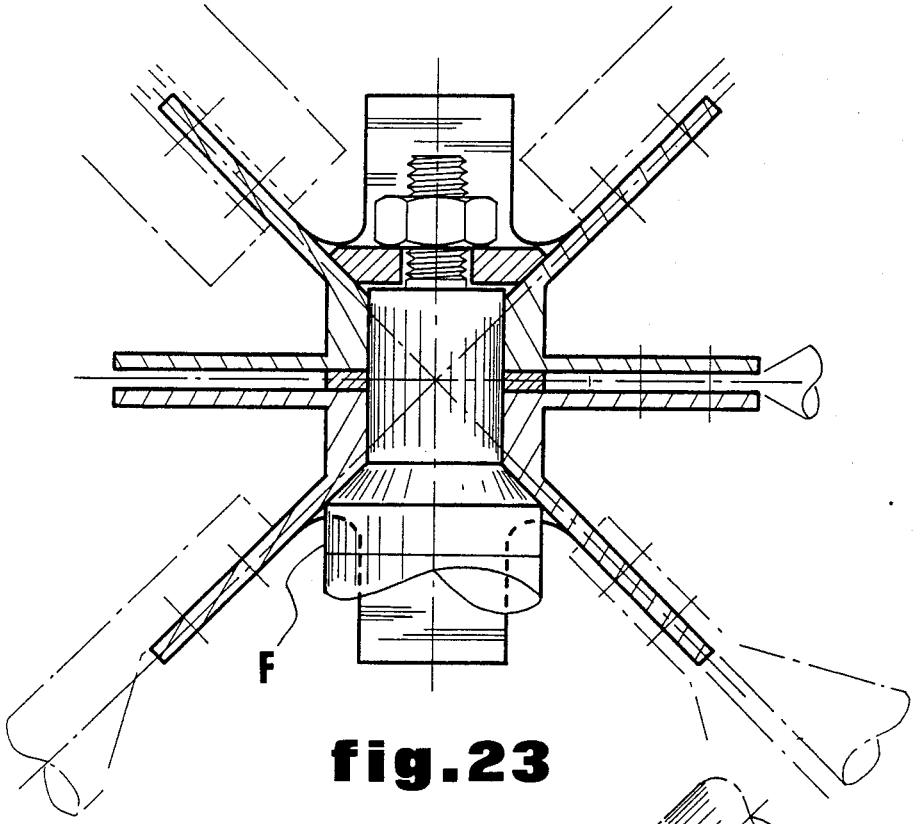

In FIG. 23, there is a combination of two integral assembly units of the same shape as that of FIG. 22.

Figure 24:
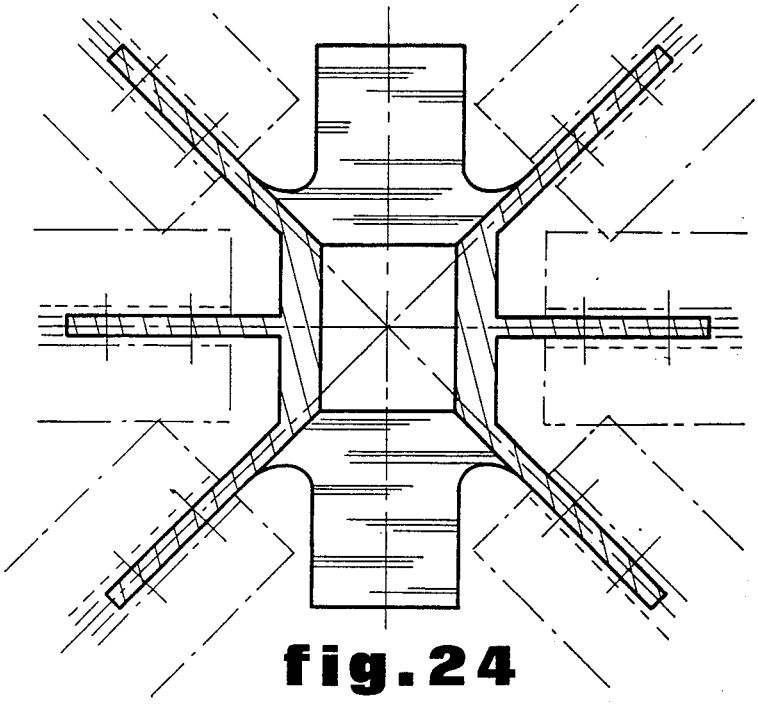

In FIG. 24 is shown an integral version of the modular combination of FIG. 16.

Figures 25, 26:
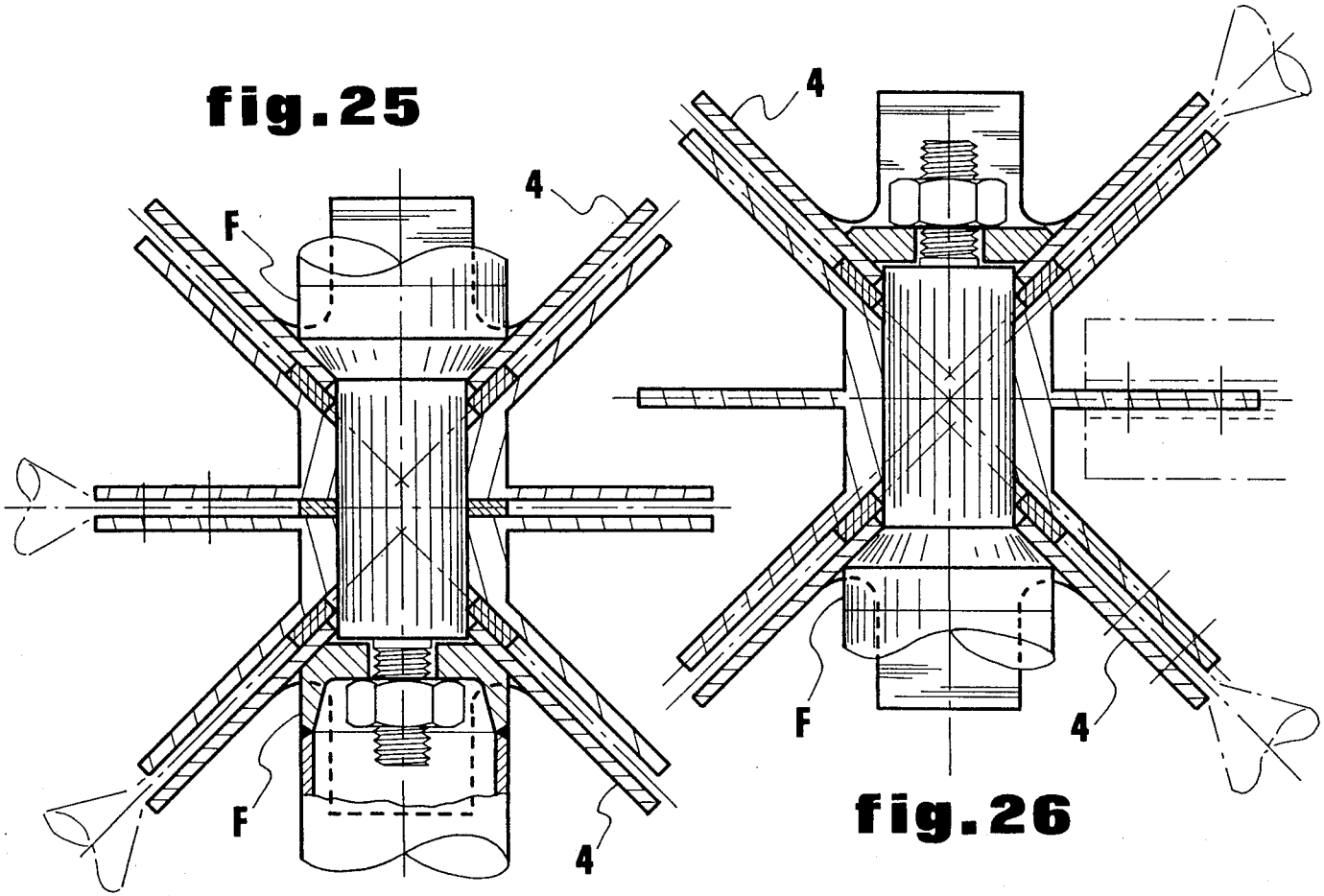

In FIG. 25 is shown a combination of two integral assembly units with two cut-away or reinforced base joints.

In FIG. 26 is shown a combination of an integral design with two cut-away or reinforced base joints.

What is claimed is:

1. A connecting and assembly modular joint for the multi-directional elements of three-dimensional structures, comprising a unitary member having a central portion of truncated conical shape whose smaller base is a circular edge lying on the conical contour of said central portion and surrounding a round hole, and at least one flat portion extending outward and as a continuation of said central portion, said at least one flat portion lying on the surface of a regular polygon.

2. A joint as claimed in claim 1, in which at least on straight line lies both on said conical central portion and on said at least one flat portion.

3. A joint as claimed in claim 1, there being a plurality of said flat portions each lying on a different side of said regular polygon.

4. A joint as claimed in claim 1, comprising a plurality of said elements mounted in unitary assembly with said truncated conical central portions of at least two of said elements being coaxial.

5. A joint as claimed in claim 3, which is cut away between said flat portions whereby said flat portions constitute a plurality of legs.

6. A joint as claimed in claim 5, in which the end of at least one said leg is bent out of its plane.

7. A joint as claimed in claim 5, in which the ends of all said legs are bent out of their planes.

8. A joint as claimed in claim 1, in which said truncated conical central portion has a summit angle between 5° and 17° summit.

9. A joint as claimed in claim 4, and a plurality of linear elements connected to each of said flat portions.

* * * * *